US006286450B1

(12) United States Patent
Murrin et al.

(10) Patent No.: US 6,286,450 B1
(45) Date of Patent: Sep. 11, 2001

(54) CAP ASSEMBLY FOR RIGHT OF WAY LINE MARKER

(75) Inventors: Pamela C. Murrin, Fort Worth; Charles I. Allen, Houston, both of TX (US)

(73) Assignee: S&B Technical Products, Inc., Forth Worth, TX (US)

( * ) Notice: Subject to any disclaimer, the term of this patent is extended or adjusted under 35 U.S.C. 154(b) by 0 days.

(21) Appl. No.: 09/416,386

(22) Filed: Oct. 12, 1999

(51) Int. Cl.[7] ..... G09F 15/00

(52) U.S. Cl. ..... 116/209; 116/201; 116/63 R

(58) Field of Search ..... 116/209, 200, 116/201, 202, 63 R; 52/103, 738.1, 736.3, 736.4, 723.1, 723.2; 404/6, 9, 10; 40/612, 607, 606, 645, 661.05, 661.12; 248/507, 219.2

(56) References Cited

U.S. PATENT DOCUMENTS

| | | | | |
|---|---|---|---|---|
| 1,435,363 | * | 11/1922 | Wood | 40/608 |
| 2,186,428 | * | 1/1940 | Patten | 40/645 |
| 2,779,240 | * | 1/1957 | Gaydos | 359/514 |
| 2,790,257 | * | 4/1957 | Ware | 40/645 |
| 3,267,805 | * | 8/1966 | Ackerman | 359/538 |
| 3,928,930 | * | 12/1975 | Attwood | 40/607 |
| 3,935,655 | * | 2/1976 | Fritzinger | 40/607 |
| 4,106,879 | * | 8/1978 | Diedershagen et al. | 404/10 |
| 4,250,491 | * | 2/1981 | Dotson | 340/321 |
| 4,343,567 | * | 8/1982 | Sarver et al. | 404/10 |
| 4,454,671 | * | 6/1984 | Morgenstern | 40/607 |
| 4,779,955 | * | 10/1988 | Schmanski | 359/552 |
| 5,299,883 | * | 4/1994 | Arth, Jr. | 404/10 |
| 5,956,875 | * | 9/1999 | Aughenbaugh | 40/607 |

OTHER PUBLICATIONS

Maloney LineMRKR brochure 1998.

* cited by examiner

*Primary Examiner*—Diego Gutierrez
*Assistant Examiner*—R. Alexander Smith
(74) *Attorney, Agent, or Firm*—Bracewell & Patterson LLP

(57) ABSTRACT

A cap assembly is shown for a right of way line marker which includes a cap body with a conical exterior and an end opening. A mounting assembly including a lower, stationary disk and an upper, sliding disk are received within the end opening of the cap body. The lower disk has an aperture therein for receiving the upper end of a vertical support member. The upper sliding disk is positionable within the cap open interior upon contact with the upper end of the support member to thereby securely mount the cap assembly about the right of way line marker.

10 Claims, 3 Drawing Sheets

CAP ASSEMBLY FOR RIGHT OF WAY LINE MARKER

BACKGROUND OF THE INVENTION

1. Field of the Invention

The present invention relates generally to line marker posts for marking the location of buried conduit such as pipeline or utility conduit.

2. Description of the Prior Art

A variety of pipeline or utility marking systems are in use at the present time. The purpose of these pipeline or utility marking systems is to indicate the location of buried pipeline, cable, conduit, etc., (referred to collectively as conduit herein), as well as to identify its owner. By properly marking the subterranean conduit, construction crews and others attempting to excavate the site can avoid accidentally damaging the buried conduit. The marker also serves as a warning to the general public that a buried conduit is present in the area.

Applicants have introduced a right of way line marker, sold as the "Maloney Line MRKR" system which has enjoyed commercial success. This marker system includes an upright support member which has a cylindrical exterior with a lower end which is positionable within a surrounding terrain so that the upright member is positioned in an upright vertical position. The cylindrical upright member carries an end cap on the upper exposed extent thereof. The end cap and upright support member are preferably formed of a synthetic plastic such as high density polyethylene. Either the end cap or an associated sleeve carries indicative marking such as "GAS PIPELINE", "WARNING PETROLEUM PIPELINE", or "FIBER OPTIC CABLE." The marker post is available in vivid colors that stand out against any background. A typical marker is provided in, for example, 3.75 inch OD tubular design, and is highly visible from any angle as well as from the air. The addition of a fluorescent cap enhances visibility for aerial observation.

The tubular nature of the "Maloney Line MRKR" offers several advantages over the traditional "flat" right of way line marker posts. For example, the polymeric tubular marker cannot spark when struck, thereby eliminating the possibility of spark ignition, fire or explosion and is less susceptible to "wind whi" that can occur with flat line markers. The greatest advantage of the tubular design is perhaps the ease of visibility from any angle, as well as from the air. The traditional flat line markers are actually U-shaped in cross-section and are used for a variety of purposes, including standard highway sign indicia, such as stop signs.

In spite of the advantages of the synthetic, tubular line marker, a large number of flat line markers exist is use today. It would be advantageous to provide a tubular cap assembly for such flat line markers which would allow the marker post to be equipped or retrofitted with a high visibility tubular cap.

It is accordingly an object of the present invention to provide a cap assembly for a traditional flat right of way line marker which allows a conical end cap to be quickly and exactly installed on the exposed upper end of the marker post.

Another object of the invention is to provide a cap assembly which includes a unique mounting assembly for quickly and securely mounting the conical end cap upon the upright marker post.

Another object of the invention is to provide such a cap assembly which is simple in design and economical to manufacture.

SUMMARY OF THE INVENTION

A cap assembly is shown for a right of way line marker which includes an upright support member having an exposed upper end and a lower end. The lower end is positionable within a surrounding terrain in use to position the support member in an upright vertical position. The assembly includes a cap body having a conical exterior with an end opening and an initially open interior. The cap also includes a mounting assembly comprising a lower, stationary disk which is sized to be received and retained within the end opening of the cap body and an upper, sliding disk. The lower, stationary disk has an aperture therein for receiving the upper end of the support member. The upper, sliding disk is positionable within the cap open interior upon contact with the upper end of the support member to provide stability for the cap assembly.

Preferably, the upper and lower disks each have upper and lower planar surfaces, respectively, the planar surfaces being arranged in a plane generally perpendicular to the vertical axis of the support member in use. A locking detent is located on the upper planar surface of the lower disk. The locking detent is engageable with mating openings provided on the upright support member for locking the lower disk and, in turn, the cap at a plurality of selected vertical locations on the support member. The lower disk can be formed of a resilient synthetic material whereby the locking detent can be provided as a flexible tab which is integrally formed with the upper planar surface of the lower disk.

Preferably, the upper and lower disks have mating engagement members which are located thereon. In this way, the disk components can initially be assembled with the respective planar faces thereof in contact, thereby forming a compact unit for shipping or for immediate installation. The unit can be easily installed within the end opening of the conical cap with the upper and lower disks located at the approximate end opening of the cap. As the support member is inserted through the aperture provided in the lower disk, it contacts the upper disk and slides the disk vertically upward within the opening interior of the cap body to a selected location therein. The presence of the lower disk with its support member receiving aperture and the upper disk provides a stable arrangement for mounting the cap assembly upon the upright support member.

In the method of the invention, a mounting assembly is installed within the end opening of a conical cap body. The mounting assembly includes the previously described lower and upper disks. The upper end of the support member is inserted through the aperture provided in the lower disk. The upper end of the support member contacts the upper disk and drives the upper disk to an axially displaced location within the cap interior. The upper and lower disks serve to securely mount the cap body about the upper end of the support member.

Additional objects, features and advantages will be apparent in the written description which follows.

DETAILED DESCRIPTION OF THE INVENTION

Figure 1:
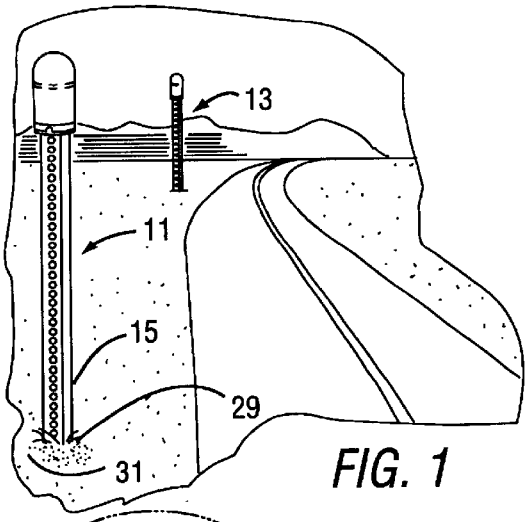
FIG. 1 is a perspective view of an earthen terrain showing the cap assembly of the invention on a traditional flat line marker located beside a highway right of way.

FIG. 1 shows a pair of marker posts used in the system of the present invention, designated generally as 11, 13. The marker posts are typically used for marking the location of buried conduit of various types including natural gas pipelines, petroleum pipelines, fiber optic, utility and telecommunication cable, etc. The line marker posts utilize an upright support member (15 in FIG. 1) which, in this case, is formed of steel.

Figure 3:
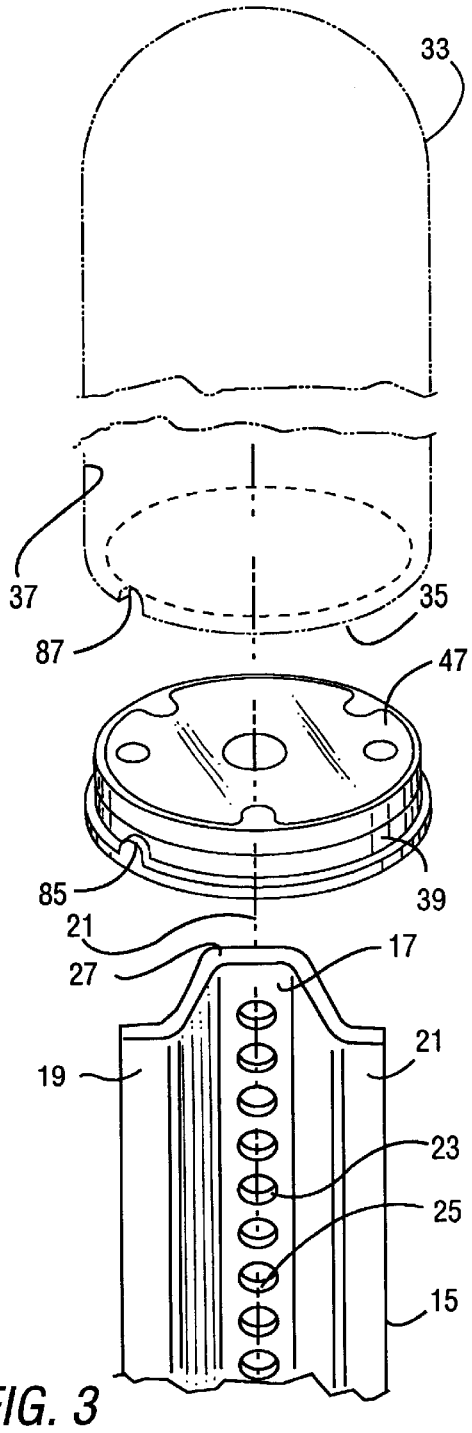
FIG. 3 is an exploded view of the cap assembly with respect to the upper end of the upright member of the line marker.
Figure 4:
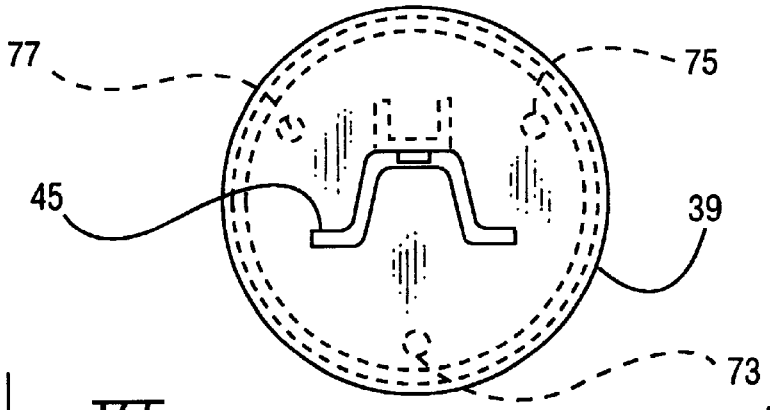
FIG. 4 is a view of the bottom planar surface of the lower disk of the cap assembly of the invention.

As best seen in FIG. 3, the upright support member 15 has a generally U-shaped cross-section defined by a channel region 17 and oppositely extending outer flanges 19, 21. The upright support member has a length defined along a vertical axis 21 and has a plurality of aligned openings, such as openings 23, 25. Which are formed in the channel region 17 and are generally aligned with the vertical axis 21.

The cap assembly of the invention is intended for use with an upright support member, such as member 15, which has an exposed upper end 27 (FIG. 3) and a lower end 29 (FIG. 1) which is positionable within a surrounding terrain 31 in use to position the upright support member 15 in an upright vertical position.

The cap assembly includes a cap body 33 having a generally conical exterior with an end opening 35 and an initially open interior 37. A mounting assembly is used to securely affix the cap body 33 to the upright support member 15. The mounting assembly includes a lower, stationary disk 39 (FIG. 2) which is sized to be received and retained within the end opening 35 of the cap body 33. The lower, stationary disk has a top and bottom planar surfaces 41, 43, respectively, and has an aperture 45 formed therein which is shaped to receive the upper end 27 of the upright support member 15. In the embodiment illustrated in FIG. 2, the aperture 45 has a generally U-shaped outline.

Figure 2:
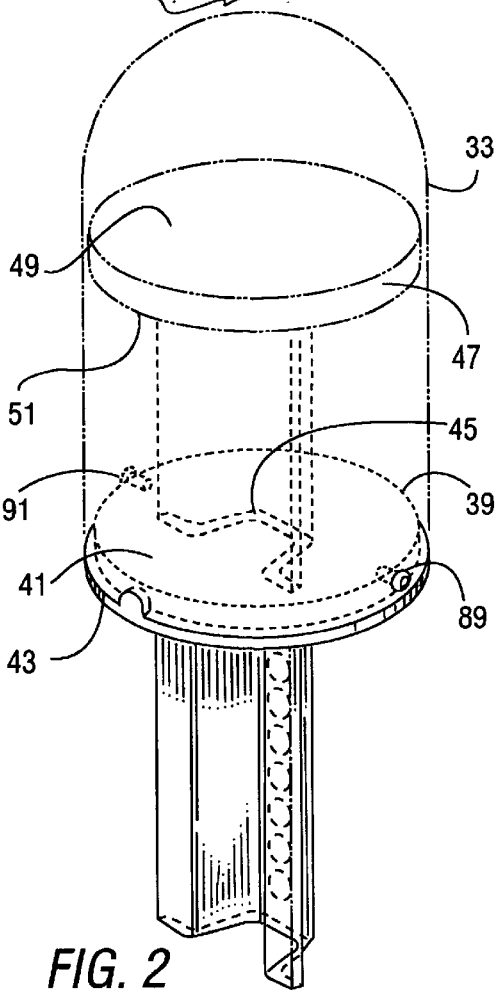
FIG. 2 is a isolated view of the cap assembly and upper end of the upright support of the liner marker with the interior components illustrated in phantom lines.
Figure 5:
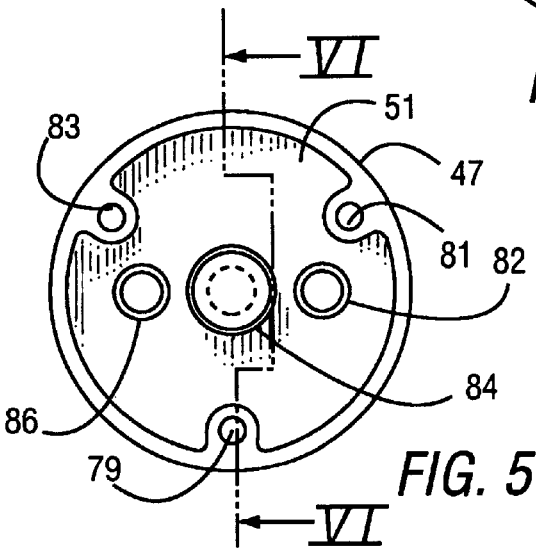
FIG. 5 is a view of the bottom planar surface of the upper disk of the cap assembly of the invention.
Figure 6:
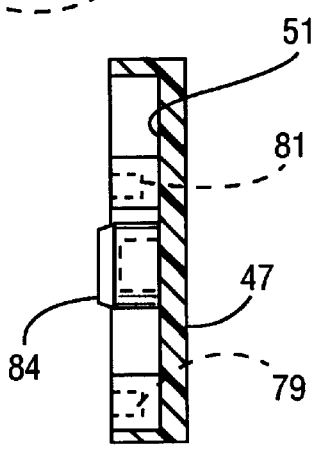
FIG. 6 is a side, cross-sectional view of the upper disk taken along lines VI—VI in FIG. 5.
Figure 7:
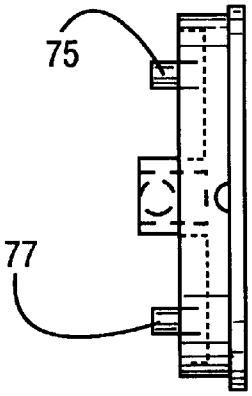
FIG. 7 is a side view of the lower disk of the cap assembly as represented in FIG. 8.
Figure 8:
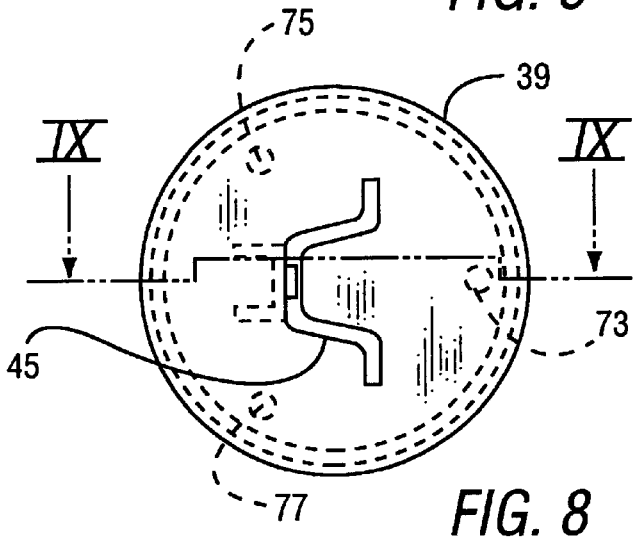
FIG. 8 is a view of the bottom planar surface of the lower disk of the cap assembly.
Figure 9:
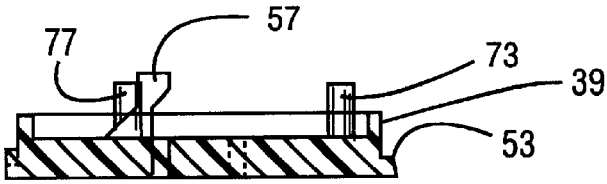
FIG. 9 is a side, cross-sectional view taken along lines VIII—VIII in FIG. 8.

The mounting assembly also includes an upper, sliding disk 47 which, as shown in FIG. 2, is positionable within the cap open interior 37. The upper disk 47 is positionable at a various axially displaced locations upon contact with the upper end 27 of the support member 15. The upper sliding disk 47 also has top and bottom planar surfaces 49, 51, respectively. The bottom planar surface 51 (FIG. 5) has three alignment or locating knobs 82, 84, 86 which straddle the upright member upper end 27 during assembly.

Preferably, the upper and lower disks are formed of a resilient synthetic material, such as a suitable plastic. The lower disk 39 is formed with an outer lip 53 which engages the lower extent 55 (FIG. 12) of the cap body 33. The lower disk 39 also has a locking detent 57 which, in the embodiment illustrated, is a flexible tab formed integrally with the upper planar surface 41 of the lower disk 39.

Figure 10:
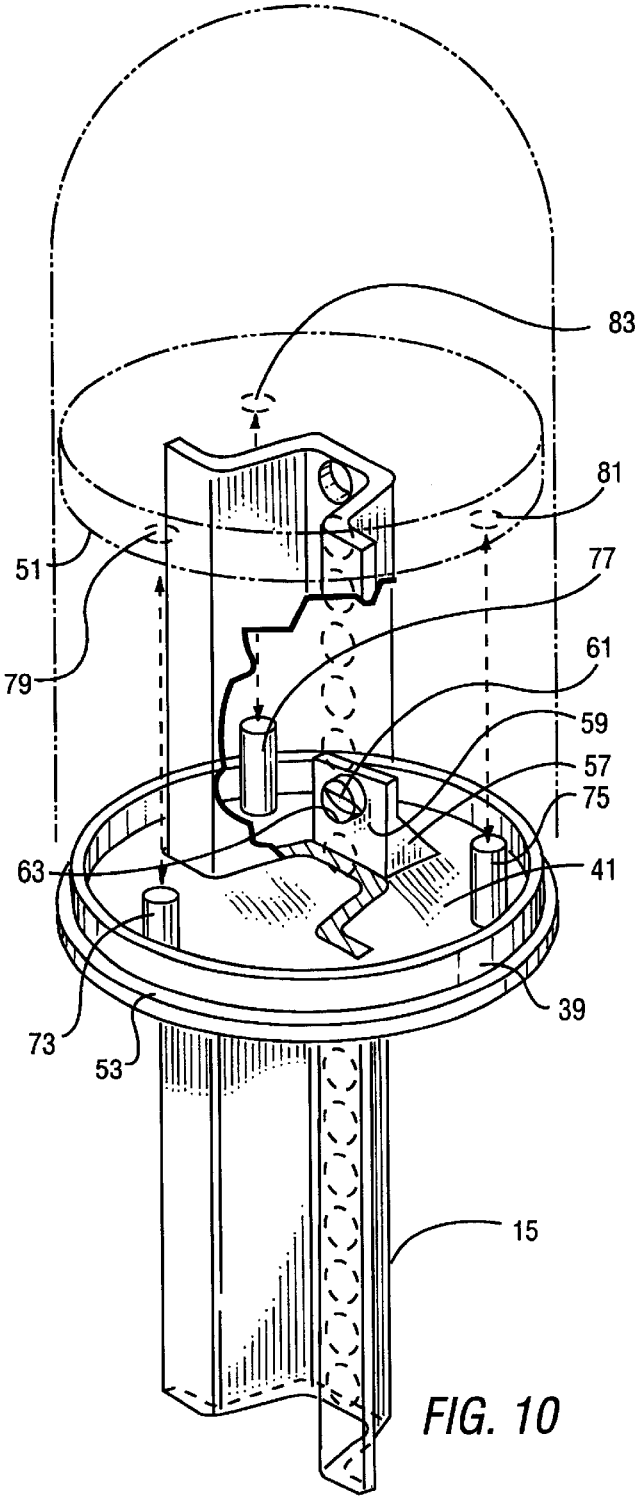
FIG. 10 is a close-up view of the installed cap assembly of the invention with certain of the internal components illustrated in phantom lines.
Figure 11:
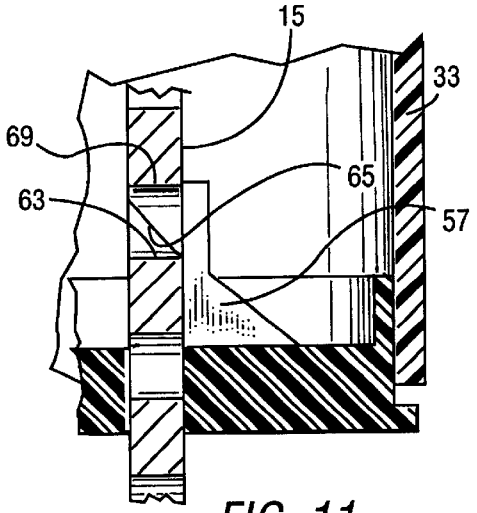
FIGS. 11 and 12 are schematic illustrations of the installation of the cap assembly of the invention showing the movement of the flexible detent carried on the lower disk thereof.
Figure 12:
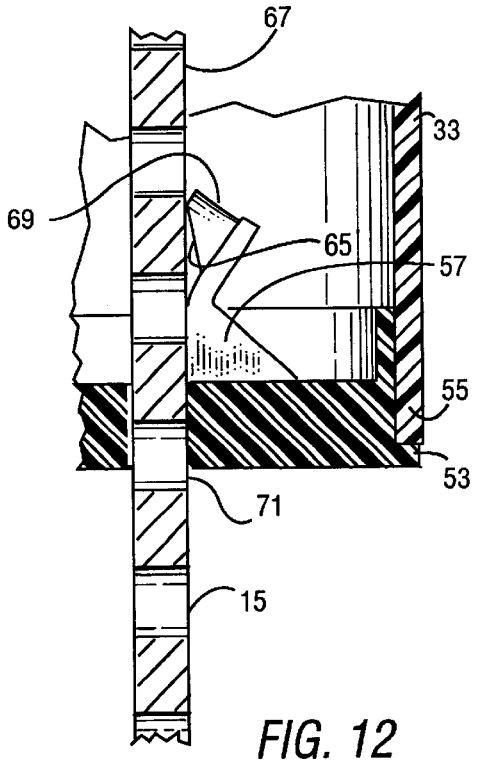

As shown in FIG. 10, the locking detent 57 includes a flexible hinge-like body 59 and a tapered projection 61. The projection 61 is engageable with the mating openings, such as opening 63 in FIG. 10, provided in the upright support member 15. As shown in FIGS. 11 and 12, the tapered lower surface 65 of the detent 57 allows the detent mechanism to ride over the contact surfaces 67 of the upright support. The upper shoulder 69 engages the opening, as shown in FIG. 11, to prevent reverse direction of travel. The assembly could be removed, once installed, by inserting a flat instrument (not shown) along the surface 71 in FIG. 12 so as to contact the tapered lower surface 65 of the detent and flex the detent radially outward, thereby allowing the cap assembly to be pulled from the upper end of the support member 15.

The lower and upper disks 39, 47, are preferably provided with mating engagement members located thereon. In this way, the disks can be initially assembled with the respective planar faces of the disks in contact and with both disks located at the approximate end opening of the cap (see FIG. 3). As shown in FIG. 10, the mating engagement members can comprise pins 73, 75, 77 which extend upwardly from the top planar surface 41 of the lower disk 39 and which are received within mating bores 79, 81, 83 provided in the bottom planar surface 51 of the upper disks 47. As shown in FIG. 3, the cap and disk assembly can also be provided with locating notches 85, 87 which are used to register the respective components so that the screw holes 89, 91 are aligned to facilitate assembly.

In the method of the invention, the cap body and mounting assembly are typically provided as an assembled unit with the lower and upper disks 39, 47 in the position shown in FIG. 3 and with the disk mounting assembly located within the end opening 35 of the cap body 33. The upper end 27 of the upright support member 15 is then inserted through the aperture 45 in the lower disk 39. As the upper end 27 of the support member is moved through the cap interior 37, it contacts the upper disk 47 and drives the upper disk to an axially displaced location (FIG. 2) within the cap interior 37. The upper and lower disks thus serve to securely mount the cap body 33 about the upper end 27 of the support member 15.

As the upper end of the support member moves within the cap interior, the flexible detent 57 carried on the lower disk 39 rides along the exterior surface 71 of the upright member, as shown in FIG. 12. When the upper disk 47 has wedged within the cap interior, the detent projection 61 locates within an adjacent opening (63 in FIGS. 10 and 11). The upper shoulder 69 of the detent prevents the cap from being pulled off the upright support member in the opposite direction. The detent mechanism thus locks the lower disk 39 and, in turn, the cap 33 at a plurality of selected vertical locations on the support member 15.

An invention has been provided with several advantages. The cap assembly of the invention allows a traditional flat right of way line marker to be equipped or retrofitted with a conical cap assembly. The conical cap assembly permits better visibility of the marking indicia since it provides a three dimensional profile to the viewer. The cap can be provided of a synthetic material which can assume a variety of shapes and colors. By providing the cap of an ultraviolet stabilized high density polyethylene, the components will not fade, warp, absorb water or otherwise deteriorate from prolonged exposure to the elements. By providing a cap of a fluorescent color, the line marker is highly visible from any angle as well as from the air.

While the invention has been shown in only one of its forms, it is not thus limited but is susceptible to various changes and modifications without departing from the spirit thereof.

What is claimed is:

1. A cap assembly for a right of way line marker which includes an upright support member having an exposed upper end and a lower end, the lower end being positionable within a surrounding terrain in use to position the support member in an upright vertical position, the assembly comprising:

a cap body having a conical exterior with an end opening and an initially open interior;

a mounting assembly including a lower, stationary disk sized to be received and retained within the end opening of the cap body, the lower, stationary disk having an aperture therein for receiving the upper end of the support member, the mounting assembly also including an upper, sliding disk which is positionable within the cap open interior upon contact with the upper end of the support member.

2. The cap assembly of claim 1, wherein the support member has a length defined along a vertical axis, each of the upper and lower disks having a top and bottom planar surfaces, respectively, the planar surfaces capable of being arranged in a plane generally perpendicular to the vertical axis of the support member.

3. The cap assembly of claim 2, wherein a locking detent is located on the top planar surface of the lower disk, the locking detent being engageable with mating openings provided on the support member for locking the lower disk and, in turn, the cap at a plurality of selected vertical locations on the support member.

4. The cap assembly of claim 3, wherein the lower disk is formed of a resilient synthetic material and wherein the locking detent is a flexible tab formed integrally with the top planar surface of the lower disk.

5. The cap assembly of claim 4, wherein the upper and lower disks have mating engagement members located thereon, whereby the disks can be initially assembly with the respective planar faces of the disks in contact and with both disks located at the approximate end opening of the cap.

6. The cap assembly of claim 5, wherein the support member has a U-shaped cross section and wherein the aperture formed in the lower disk is a mating U-shape.

7. A method of installing a cap assembly on a right of way line marker which includes an upright support member having an exposed upper end and a lower end, the lower end being positionable within a surrounding terrain in use to position the support member in an upright vertical position, the installation method comprising the steps of:

providing a cap body having a conical exterior with an end opening and an initially open interior;

installing a mounting assembly within the end opening of the cap body, the mounting assembly including a lower, stationary disk sized to be received and retained within the end opening of the cap body, the lower, stationary disk having an aperture therein for receiving the upper end of the support member, the mounting assembly also including an upper, sliding disk which is positionable within the cap open interior upon contact with the upper end of the support member;

inserting the upper end of the support member through the aperture provided in lower disk, whereby the upper end of the support member contacts the upper disk and drives the upper disk to an axially displaced location within the cap interior, the upper and lower disks serving to securely mount the cap body about the upper end of the support member.

8. The method of claim 7, wherein the support member has a length defined along a vertical axis, each of the upper and lower disks having a top and a bottom planar surface, respectively, the planar surfaces being arranged in a plane generally perpendicular to the vertical axis of the support member and wherein a locking detent is located on the top planar surface of the lower disk, the locking detent being engageable with mating openings provided on the support member for locking the lower disk and, in turn, the cap at a plurality of selected vertical locations on the support member.

9. The method of claim 8, wherein the lower disk is formed of a resilient synthetic material and wherein the locking detent is a flexible tab formed integrally with the top planar surface of the lower disk.

10. The method of claim 9, wherein the upper and lower disks are formed with mating engagement members located thereon, whereby the disks can be initially assembly with the top planar face of the lower disk in contact with the bottom planar face of the upper disk and with both disks located at the approximate end opening of the cap body.

* * * * *